US012727625B2

(12) United States Patent
Lee

(10) Patent No.: US 12,727,625 B2
(45) Date of Patent: Sep. 8, 2026

(54) AEROSOL GENERATING DEVICE AND METHOD OF CONTROLLING THE SAME

(71) Applicant: KT&G CORPORATION, Daejeon (KR)

(72) Inventor: Moon Bong Lee, Seoul (KR)

(73) Assignee: KT&G Corporation, Daejeon (KR)

( * ) Notice: Subject to any disclaimer, the term of this patent is extended or adjusted under 35 U.S.C. 154(b) by 767 days.

(21) Appl. No.: 17/793,255

(22) PCT Filed: Apr. 6, 2021

(86) PCT No.: PCT/KR2021/004284

§ 371 (c)(1),
(2) Date: Jul. 15, 2022

(87) PCT Pub. No.: WO2021/206421

PCT Pub. Date: Oct. 14, 2021

(65) Prior Publication Data

US 2023/0057748 A1 Feb. 23, 2023

(30) Foreign Application Priority Data

Apr. 8, 2020 (KR) ..... 10-2020-0042968

(51) Int. Cl.
*A24F 40/60* (2020.01)
*A24F 40/20* (2020.01)
*A24F 40/53* (2020.01)

(52) U.S. Cl.
CPC ..... *A24F 40/60* (2020.01); *A24F 40/20* (2020.01); *A24F 40/53* (2020.01)

(58) Field of Classification Search
None
See application file for complete search history.

(56) References Cited

U.S. PATENT DOCUMENTS

| | | | |
|---|---|---|---|
| 10,674,767 | B2 | 6/2020 | Hedarchet |
| 10,863,773 | B2 | 12/2020 | Suzuki et al. |
| 2010/0307518 | A1 | 12/2010 | Wang |
| 2012/0048266 | A1 | 3/2012 | Alelov |

(Continued)

FOREIGN PATENT DOCUMENTS

| | | | |
|---|---|---|---|
| CN | 105077590 | A | 11/2015 |
| CN | 105473011 | A | 4/2016 |

(Continued)

OTHER PUBLICATIONS

US 11,350,663 B2, 06/2022, Han et al. (withdrawn)

(Continued)

*Primary Examiner* — Jill A Warden
(74) *Attorney, Agent, or Firm* — Foley & Lardner LLP

(57) ABSTRACT

An aerosol generating device includes a heating element configured to heat an aerosol generating material, a battery configured to supply power to the heating element and receive power from an external device, an output unit, and a processor configured to control the output unit to output a notification indicating whether the aerosol generating device is usable, within a predetermined time period after power supply from the battery to the heating element is discontinued, or within the predetermined time period after the battery is charged to a predetermined level.

9 Claims, 6 Drawing Sheets

(56) References Cited

U.S. PATENT DOCUMENTS

| | | | | |
|---|---|---|---|---|
| 2013/0319435 | A1 | 12/2013 | Flick et al. | |
| 2013/0340750 | A1 | 12/2013 | Thorens et al. | |
| 2014/0299141 | A1 | 10/2014 | Flick | |
| 2015/0257445 | A1 | 9/2015 | Henry et al. | |
| 2015/0272223 | A1 | 10/2015 | Weigensberg et al. | |
| 2016/0211693 | A1 | 7/2016 | Stevens et al. | |
| 2017/0238610 | A1 | 8/2017 | Reevell | |
| 2017/0318861 | A1 | 11/2017 | Thorens | |
| 2017/0360097 | A1 | 12/2017 | Xiang | |
| 2018/0098576 | A1 | 4/2018 | Hedarchet | |
| 2018/0220711 | A1 | 8/2018 | Suzuki et al. | |
| 2018/0271155 | A1 | 9/2018 | Baker et al. | |
| 2018/0296779 | A1 | 10/2018 | Takeuchi et al. | |
| 2018/0338531 | A1 | 11/2018 | Reevell | |
| 2019/0208824 | A1 | 7/2019 | Wright | |
| 2019/0240429 | A1 | 8/2019 | Skoda | |
| 2020/0037667 | A1 | 2/2020 | Woodcock | |
| 2020/0093177 | A1* | 3/2020 | Han | A24F 40/90 |
| 2020/0154773 | A1 | 5/2020 | Lim et al. | |
| 2020/0245690 | A1 | 8/2020 | Yamada et al. | |
| 2020/0260793 | A1 | 8/2020 | Yamada et al. | |
| 2020/0305513 | A1 | 10/2020 | Fernando | |
| 2021/0106051 | A1 | 4/2021 | Han et al. | |
| 2021/0251044 | A1 | 8/2021 | Reevell | |
| 2021/0259315 | A1* | 8/2021 | Lin | A24F 40/42 |
| 2021/0307404 | A1 | 10/2021 | Shafer | |
| 2021/0345682 | A1 | 11/2021 | Yan et al. | |
| 2022/0087311 | A1 | 3/2022 | Han et al. | |
| 2023/0142151 | A1 | 5/2023 | Amir | |
| 2023/0248067 | A1 | 8/2023 | Smith et al. | |

FOREIGN PATENT DOCUMENTS

| | | | |
|---|---|---|---|
| CN | 108576929 | A | 9/2018 |
| CN | 108720089 | A | 11/2018 |
| CN | 109315837 | A | 2/2019 |
| CN | 110325058 | A | 10/2019 |
| EA | 201691950 | A1 | 1/2017 |
| EA | 29524 | B1 | 4/2018 |
| EP | 3 355 728 | B1 | 8/2018 |
| EP | 3 610 742 | A2 | 2/2020 |
| JP | 2013-54574 | A | 12/2013 |
| JP | 2013-545474 | A | 12/2013 |
| JP | 3210447 | U | 5/2017 |
| JP | 2017-538408 | A | 12/2017 |
| JP | 2018-533923 | A | 11/2018 |
| JP | 2019-509727 | A | 4/2019 |
| JP | 2019-524069 | A | 9/2019 |
| JP | 2020-022511 | A | 2/2020 |
| JP | 2020-507311 | A | 3/2020 |
| KR | 20-2014-0005077 | U | 9/2014 |
| KR | 10-1609715 | B1 | 4/2016 |
| KR | 10-2018-0070440 | A | 6/2018 |
| KR | 10-2018-0115684 | A | 10/2018 |
| KR | 10-2019-0019114 | A | 2/2019 |
| KR | 10-2019-0034514 | A | 4/2019 |
| KR | 10-2019-0051785 | A | 5/2019 |
| KR | 10-2019-0093025 | A | 8/2019 |
| KR | 10-2022814 | B1 | 9/2019 |
| RU | 2509516 | C2 | 3/2014 |
| RU | 2 613 785 | C2 | 3/2017 |
| RU | 2643603 | C2 | 2/2018 |
| RU | 2651475 | C2 | 4/2018 |
| RU | 2677158 | C1 | 1/2019 |
| RU | 2 700 834 | C2 | 9/2019 |
| RU | 2710470 | C1 | 12/2019 |
| WO | 2014/040988 | A2 | 3/2014 |
| WO | 2017/057286 | A1 | 4/2017 |
| WO | 2018/110834 | A2 | 6/2018 |
| WO | WO-2018110834 | A3 * | 6/2018 | A24B 15/16 |
| WO | 2018/190605 | A2 | 10/2018 |
| WO | WO-2018/182322 | A1 | 10/2018 |
| WO | 2018/206940 | A1 | 11/2018 |
| WO | 2019/082264 | A1 | 5/2019 |
| WO | WO-2019/082250 | A1 | 5/2019 |
| WO | 2019/207312 | A1 | 10/2019 |
| WO | WO-2020/023547 | A1 | 1/2020 |

OTHER PUBLICATIONS

KR20190034514A, Method and apparatus for providing adaptive feedback through puff recognition, (Year: 2019).*

Translation of WO 2019082264; May 2, 2019.*

Communication dated Jan. 9, 2024, issued in Japanese Application No. 2022-545160.

Notification of Reason for Refusal of Korean Application No. 10-2020-0042968 dated Nov. 10, 2021.

International Search Report of PCT/KR2021/004284 dated Jul. 19, 2021 [PCT/ISA/210].

Written Opinion of PCT/KR2021/004284 dated Jul. 19, 2021 [PCT/ISA/237].

Russian Office Action dated Mar. 29, 2023 in Russian Application No. 2022116680/03.

Communication dated Sep. 7, 2023 issued by the Korean Patent Office in application No. 10-2022- 0094719.

Extended European Search Report dated Dec. 14, 2022 in European Application No. 21785120.3.

Foreign Office Action with Search Report issued in RU Application No. 2023135757/03(078133) dated May 31, 2024 (14 Pages).

Japanese Office Action issued Jun. 20, 2023 in Application No. 2022-545160.

Chinese Office Action on Patent Application No. 202180014399.7 dated Apr. 1, 2025.

Japanese Office Action on Patent Application No. 2024-101923 dated May 20, 2025.

Russian Office Action on RU Patent Application No. 2025102315 dated Jul. 24, 2025.

Decision to Refuse for CN Patent Application No. 202180014399.7 dated Dec. 23, 2025.

* cited by examiner

[Fig. 1]

[Fig. 4]
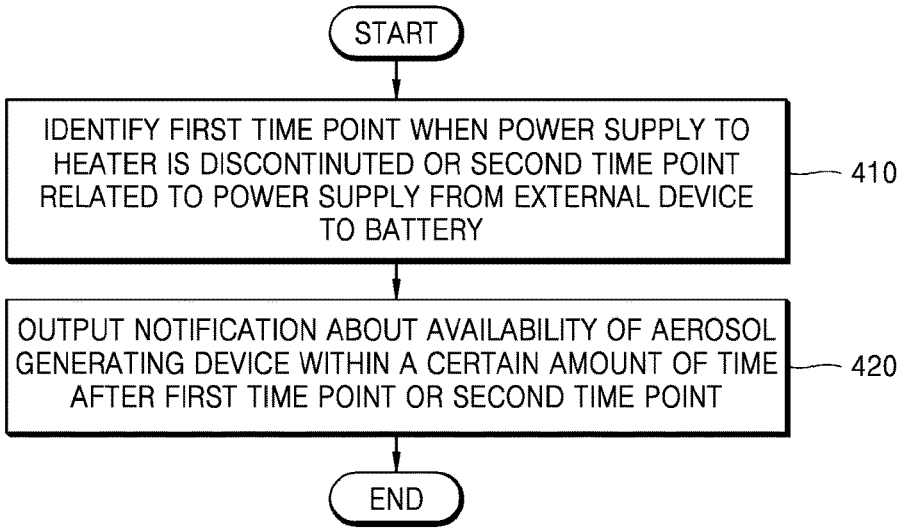
[Fig. 5]
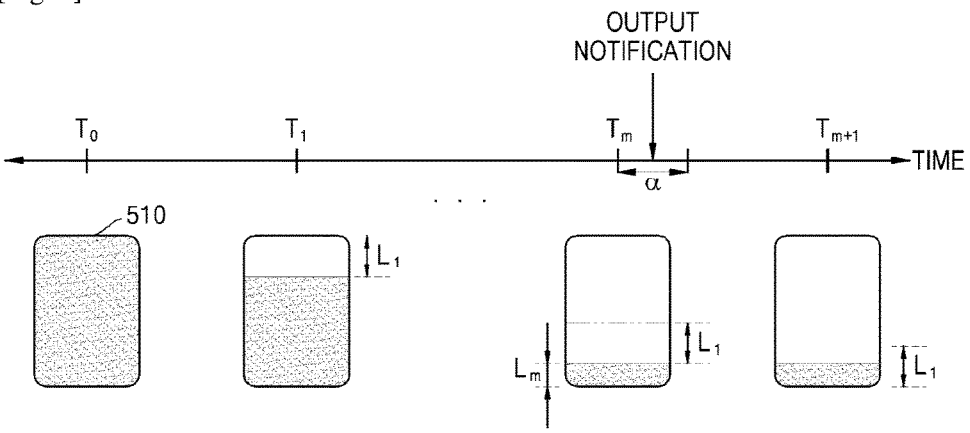
[Fig. 6]
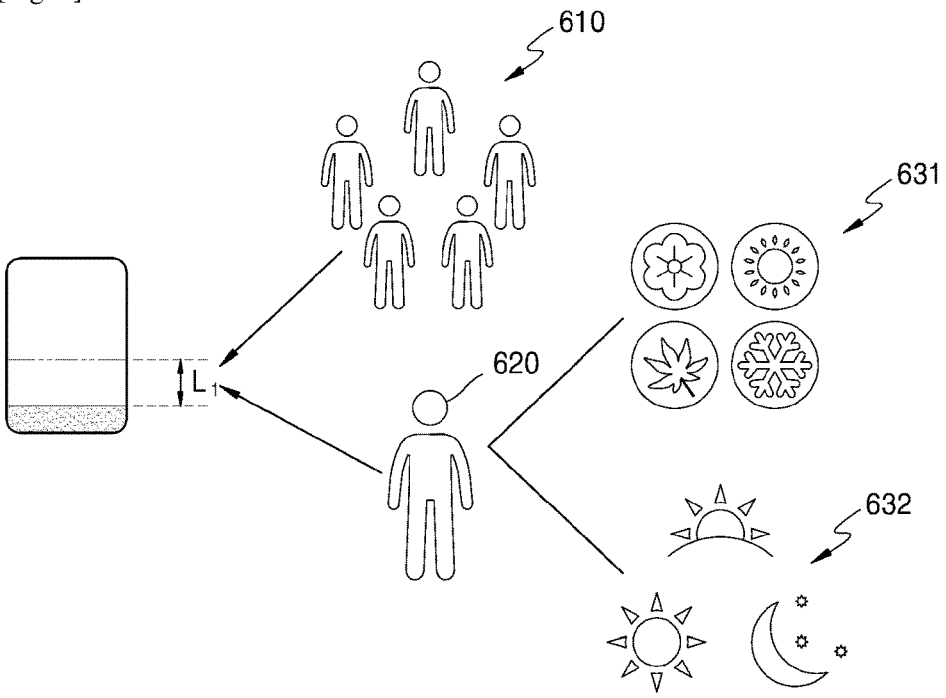

[Fig. 7]
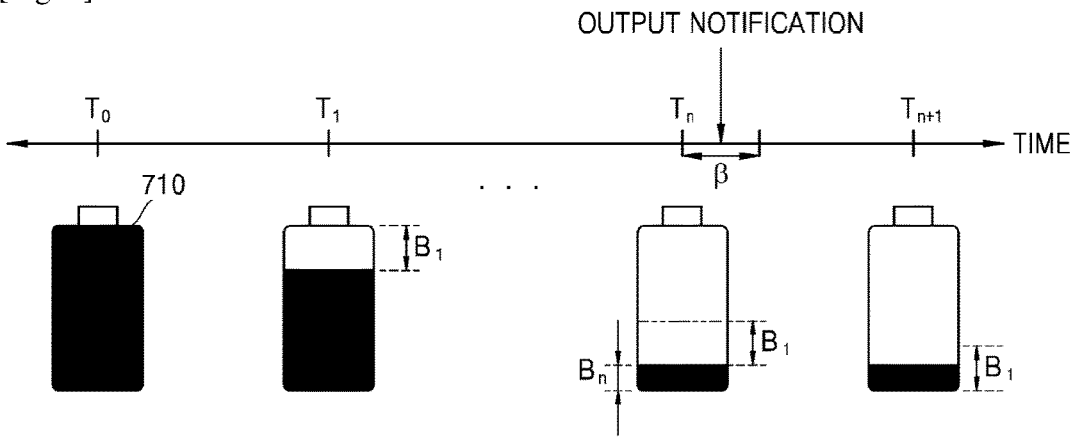
[Fig. 8]
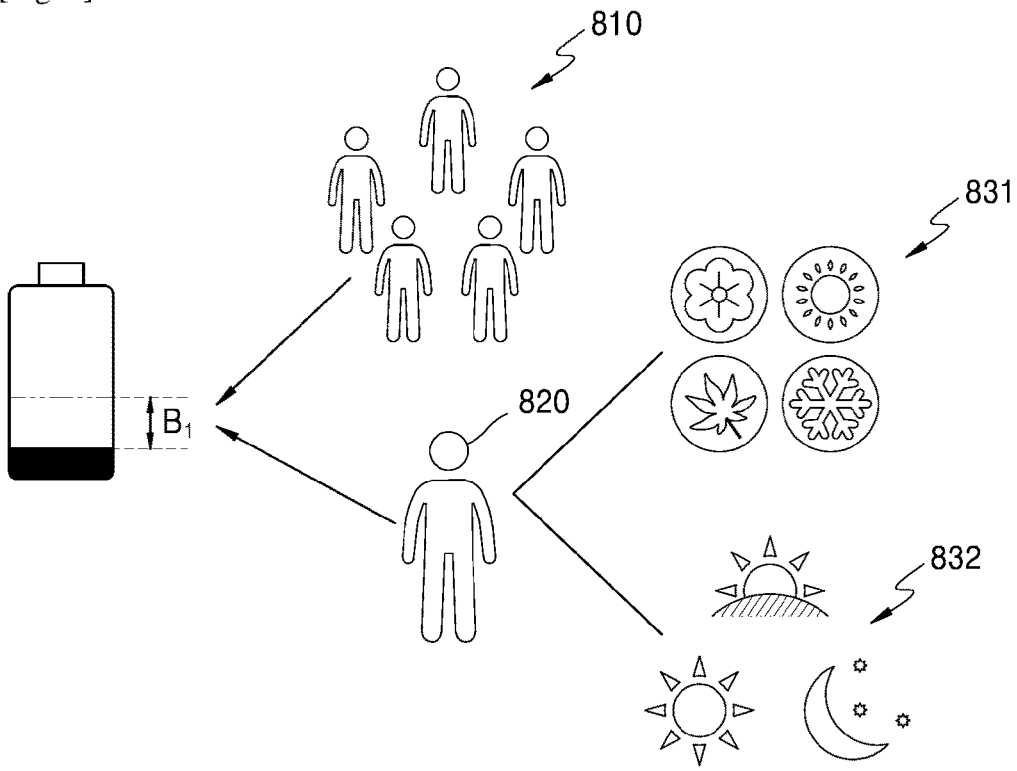
[Fig. 9]
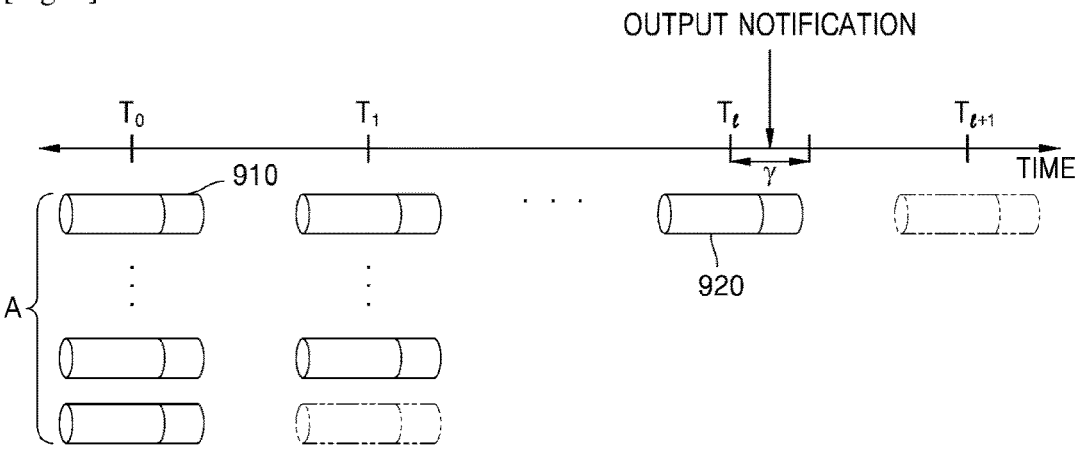

[Fig. 10]
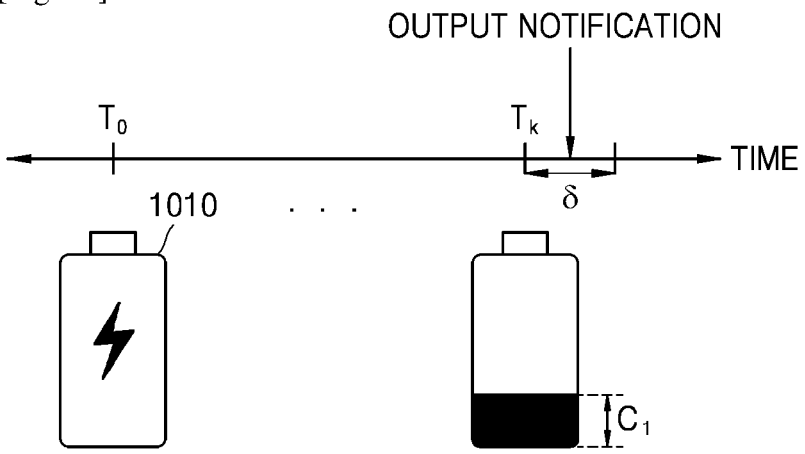
[Fig. 11]
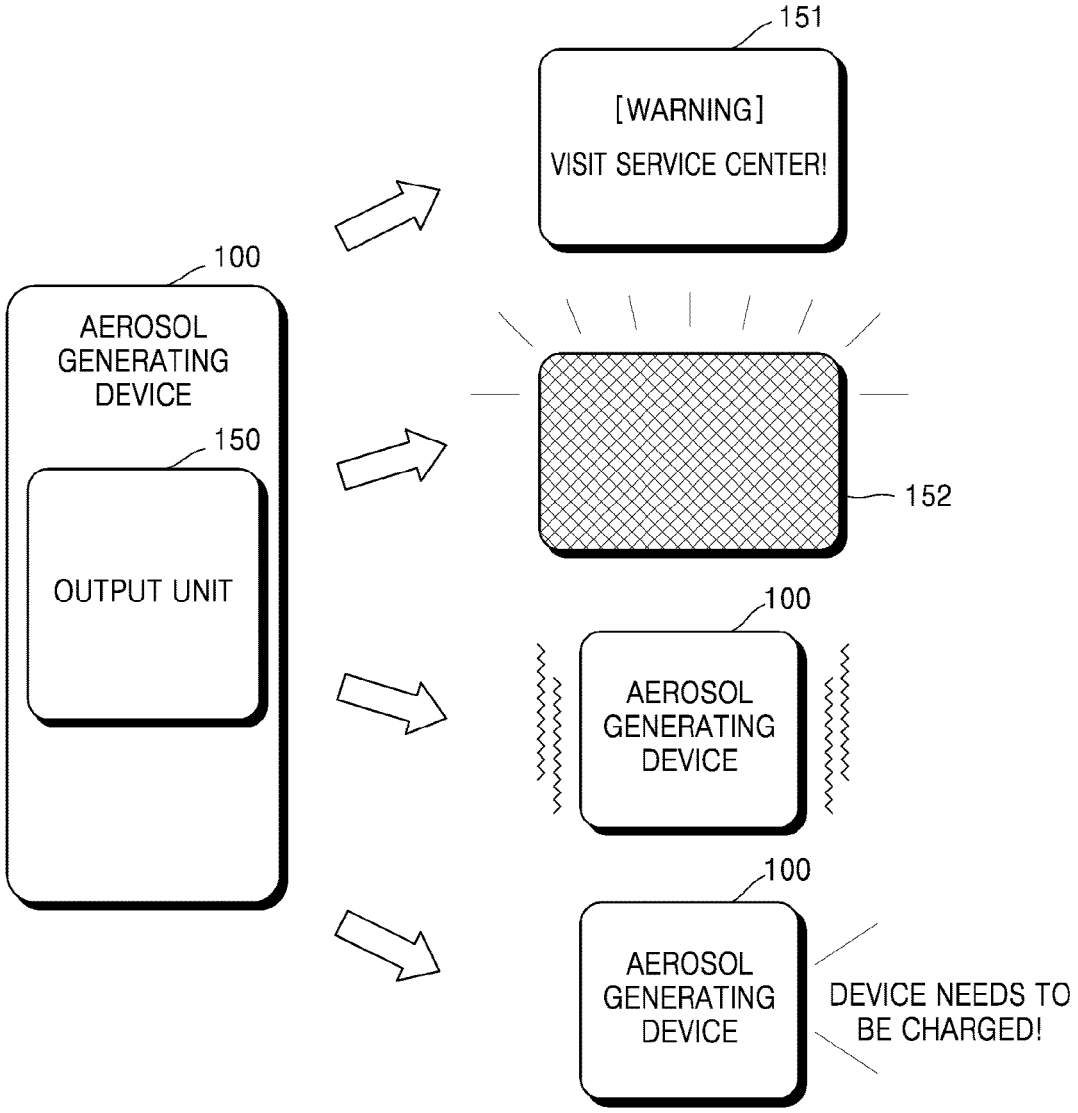

AEROSOL GENERATING DEVICE AND METHOD OF CONTROLLING THE SAME

CROSS REFERENCE TO RELATED APPLICATIONS

This application is a National Stage of International Application No. PCT/KR2021/004284, filed Apr. 6, 2021, claiming priority to Korean Patent Application No. 10-2020-0042968, filed Apr. 8, 2020.

TECHNICAL FIELD

The present disclosure relates to an aerosol generating device and a method of controlling the same.

BACKGROUND ART

Recently, the demand for an alternative to traditional cigarettes has increased. For example, there is growing demand for an aerosol generating device that generates aerosols by heating an aerosol generating material in cigarettes, rather than by combusting cigarettes. Accordingly, researches on a heating-type cigarette and a heating-type aerosol generating device have been actively conducted.

DISCLOSURE OF INVENTION

Technical Problem

There is a need to prevent a situation in which a user cannot use an aerosol generating device because of a lack of consumables or a lack of remaining power of a battery.

Solution to Problem

According to an aspect of the present disclosure, an aerosol generating device includes a heating element configured to heat an aerosol generating material, a battery configured to supply power to the heating element and receive power from an external device, an output unit, and a processor configured to control the output unit to output a notification indicating whether the aerosol generating device is usable, within a predetermined time period after power supply from the battery to the heating element is discontinued, or within the predetermined time period after the battery is charged to a predetermined level.

According to another aspect of the present disclosure, there is provided a method of controlling an aerosol generating device, the method including identifying a first time point when power supply from a battery to a heating element is discontinued, or a second time point the battery is charged to a predetermined level; and outputting a notification indicating whether the aerosol generating device is usable, within a predetermined time period after the first time point or the second time point.

According to another aspect of the present disclosure, there is provided a computer-readable recording medium having recorded thereon a program for executing the method on a computer.

Advantageous Effects of Invention

An aerosol generating device monitors consumables (e.g., liquid compositions, aerosol generating products, etc.) and a battery and outputs a notification indicating whether another smoking act consisting of a certain number of puffs is available after a previous smoking act is finished. Also, while the battery is charging, when the amount of power corresponding to one smoking act is charged to the battery, the aerosol generating device outputs a notification. Therefore, it is unnecessary for the user to monitor the state of the aerosol generating device manually, and thus, the user convenience is improved.

BRIEF DESCRIPTION OF DRAWINGS

FIG. 4 is a flowchart of an example of a method of controlling an aerosol generating device.

FIG. 5 illustrates an example in which a processor outputs a notification by using an output unit.

FIG. 6 illustrates one-time liquid consumption.

FIG. 7 illustrates another example in which a processor outputs a notification by using an output unit.

FIG. 8 illustrates one-time power consumption.

FIG. 9 illustrates another example in which a processor outputs a notification by using an output unit.

FIG. 10 illustrates another example in which a processor outputs a notification by using an output unit.

FIG. 11 illustrates different types of notifications.

BEST MODE FOR CARRYING OUT THE INVENTION

Figure 1:
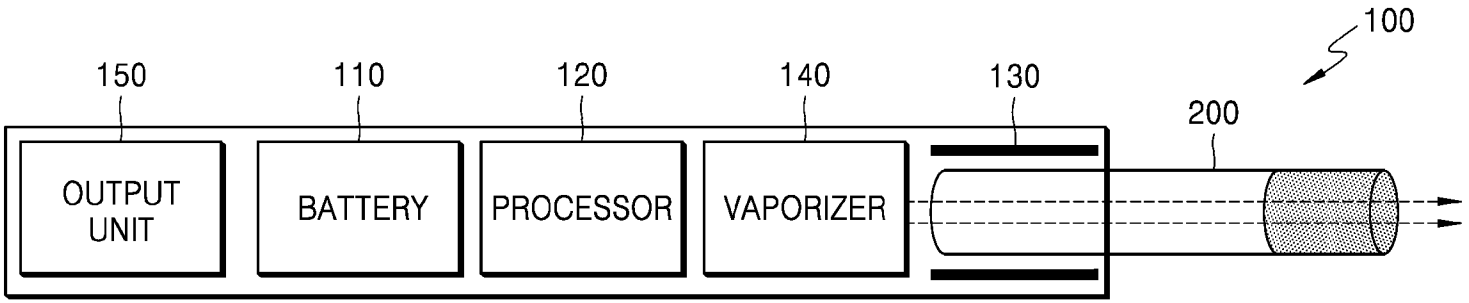
FIG. 1 illustrates an example of an aerosol generating device.

An aerosol generating device may include: a heating element configured to heat an aerosol generating material; a battery configured to supply power to the heating element and receive power from an external device; an output unit; and a processor configured to control the output unit to output a notification indicating whether the aerosol generating device is usable, within a predetermined time period after power supply from the battery to the heating element is discontinued, or within the predetermined time period after the battery is charged to a predetermined level.

The aerosol generating device may further include a storage configured to accommodate the aerosol generating material, wherein the notification indicates that a remaining amount of the aerosol generating material is less than an amount corresponding to one smoking act consisting of a predetermined number of puffs.

The amount corresponding to the one smoking act may be differently determined according to an environment in which a user smokes.

The notification may indicate that remaining power of the battery is less than an amount of power that corresponds to one smoking act consisting of a predetermined number of puffs.

The amount of power that corresponds to the one smoking act may be differently determined according to an environment in which a user smokes.

The notification may indicate a remaining number of an aerosol generating product, and the aerosol generating product may be configured to deliver an aerosol generated from the aerosol generating material to user's mouth such that the aerosol entrains at least one component included in the aerosol generating product.

The predetermined level may be an amount of power that corresponds to one smoking act consisting of a predetermined number of puffs.

The output unit may include at least one of a display, a light source, a motor, and a speaker.

The notification may include at least one of an image, light emission, vibration, and sound.

The image, the light emission, the vibration, or the sound of the notification may be changed as time passes.

The processor may be configured to discontinue operation of the aerosol generating device when a predetermined amount of time has passed after the notification is output.

A method of controlling an aerosol generating device may include: identifying a first time point when power supply from a battery to a heating element is discontinued, or a second time point the battery is charged to a predetermined level; and outputting a notification indicating whether the aerosol generating device is usable, within a predetermined time period after the first time point or the second time point.

The method may further include stopping operation of the aerosol generating device after a predetermined amount of time has passed after the notification is output.

MODE FOR THE INVENTION

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

The term "aerosol generating product" may refer to any article that is designed for smoking by a person puffing on the aerosol generating product. The aerosol generating product may include an aerosol generating material that generates aerosols when heated even without combustion. For example, one or more aerosol generating products may be loaded in an aerosol generating device and generate aerosols when heated by the aerosol generating device. The shape, size, material, and structure of the aerosol generating product may differ according to embodiments. Examples of the aerosol generating product may include, but are not limited to, a cigarette-shaped substrate and a cartridge. Hereinafter, the term "cigarette" (i.e., when used alone without a modifier such as "general," "traditional," or "combustive") may refer to an aerosol generating product which has a shape similar to a traditional combustive cigarette.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

While such terms as "first," "second," etc., may be used to describe various components, such components must not be limited to the above terms. The above terms are used only to distinguish one component from another.

Hereinafter, the present disclosure will now be described more fully with reference to the accompanying drawings.

FIG. 1 illustrates an example of an aerosol generating device.

Referring to FIG. 1, an aerosol generating device 100 includes a battery 110, a processor 120, a heater 130, a vaporizer 140, and an output unit 150. Also, an aerosol generating product 200 may be inserted into an internal space of the aerosol generating device 100.

FIG. 1 illustrates that the aerosol generating device 100 includes components related to the present embodiment. Therefore, one of ordinary skill in the art could understand that other components, other than the components of FIG. 1, may be further included in the aerosol generating device 100.

FIG. 1 illustrates that the battery 110, the processor 120, the vaporizer 140, and the heater 130 are arranged in a row. However, an internal structure of the aerosol generating device 100 is not limited to the illustration of FIG. 1. In other words, according to a design of the aerosol generating device 100, the arrangements of the battery 110, the processor 120, the heater 130, and the vaporizer 140 may be changed.

When the aerosol generating product 200 is inserted into the aerosol generating device 100, the aerosol generating device 100 may generate an aerosol by driving the heater 130 and/or the vaporizer 140. The aerosol may be delivered to a user by passing through the aerosol generating product 200.

As necessary, even when the aerosol generating product 200 is not inserted into the aerosol generating device 100, the aerosol generating device 100 may heat the heater 130.

The battery 110 supplies power used to operate the aerosol generating device 100. For example, the battery 110 may supply power to heat the heater 130 and the vaporizer 140 and power necessary to drive the processor 120. Also, the battery 110 may supply power necessary to drive the output unit 150, etc. installed in the aerosol generating device 100.

The processor 120 may control overall operations of the aerosol generating device 100. In detail, the processor 120 controls operations of other components included in the aerosol generating device 100, in addition to the battery 110, the heater 130, the vaporizer 140, and the output unit 150. Also, the processor 120 may identify a state of each component of the aerosol generating device 100 and determine whether the aerosol generating device 100 is operable.

A processor can be implemented as an array of a plurality of logic gates or as a combination of a general-purpose microprocessor and a memory in which a program executable in the microprocessor is stored. Also, it will be understood by one of ordinary skill in the art that the processor can be implemented in other forms of hardware.

The heater 130 may be heated by power supplied from the battery 110. For example, when the aerosol generating product 200 is inserted into the aerosol generating device 100, the heater 130 may be positioned outside the aerosol generating product 200. Therefore, the heated heater 130 may increase a temperature of the aerosol generating material in the aerosol generating product 200.

The heater 130 may include an electro-resistive heater. For example, the heater 130 may include an electrically conductive track, and the heater 130 may be heated when currents flow through an electrically conductive track. However, the heater 130 is not limited to the example described above and may include all heaters which may be heated to a desired temperature. Here, the desired temperature may be pre-set in the aerosol generating device 100 or may be set as a temperature desired by the user.

For example, the heater 130 may have a cylindrical shape and may heat the inside or the outside of the aerosol generating product 200, according to the shape of the heating element.

Also, the aerosol generating device 100 may include a plurality of heaters 130. In this case, the heaters 130 may be inserted to the inside of the aerosol generating product 200 or the outside thereof. Also, some of the heaters 130 may be inserted into the aerosol generating product 200, and the others thereof may be arranged outside the aerosol generating product 200. Also, the shape of the heater 130 is not limited to the shape illustrated in FIG. 1 and may include various shapes.

The vaporizer 140 may generate an aerosol by heating a liquid composition, and the generated aerosol may pass through the aerosol generating product 200 to be delivered to the user. That is, the aerosol generated via the vaporizer 140 may move along an air flow passage of the aerosol generating device 100, and the air flow passage may be configured such that the aerosol generated via the vaporizer 140 passes through the aerosol generating product 200 to be delivered to the user. In this case, the aerosol generated by the vaporizer 140 entrains at least one component included in the aerosol generating product 200.

For example, the vaporizer 140 may include a liquid storage, a liquid delivery element, and a heating element, but it is not limited thereto. For example, the liquid storage, the liquid delivery element, and the heating element may be included in the aerosol generating device 100 as independent modules.

The liquid storage may store a liquid composition. The liquid composition includes at least one aerosol generating material. For example, the liquid composition may be a liquid including a tobacco-containing material having a volatile tobacco flavor component, or a liquid including a non-tobacco material. The liquid storage may be formed to be attached/detached to/from the vaporizer 140 or may be formed integrally with the vaporizer 140.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be wound around the liquid delivery element. The heating element may be heated by a current supply and may transfer heat to the liquid composition in contact with the heating element, thereby heating the liquid composition. As a result, the aerosol may be generated.

For example, the vaporizer 140 may be referred to as a cartomizer or an atomizer, but it is not limited thereto.

The output unit 150 may output various types of information regarding the aerosol generating device 100, according to the control of the processor 120. For example, the output unit 150 may include at least one of a display, a light source, a motor, and a speaker. The display outputs images. Here, the images include text. That is, the display outputs various types of text messages, figures, and the like, and thus, the display delivers visual information to the user. The light source emits light corresponding to at least one color. For example, the light source may include at least one light-emitting diode (LED), but is not limited thereto. That is, as the light source emits light according to at least one emission type, the visual information may be delivered to the user. The motor outputs vibration. In other words, as the motor operates according to at least one vibration type, tactile information may be delivered to the user. The speaker outputs sound. Here, the sound may include a beep or sound. That is, as the speaker outputs various types of beeps or sounds, acoustic information is delivered to the user.

The aerosol generating device 100 may further include general-purpose components in addition to the battery 110, the processor 120, the heater 130, the vaporizer 140, and the output unit 150. For example, the aerosol generating device 100 may include at least one sensor (a puff detection sensor, a temperature detection sensor, an aerosol generating product insertion detection sensor, or the like). Also, the aerosol generating device 100 may have a structure in which, even when the aerosol generating product 200 is inserted, external air may be introduced or internal air may be discharged.

Although not shown in FIG. 1, the aerosol generating device 100 and an additional cradle may form a system together. For example, the cradle may be used to charge the battery 110 of the aerosol generating device 100. The heater 130 may be heated while the cradle and the aerosol generating device 100 are coupled to each other.

The aerosol generating product 200 may be similar to a general cigarette in shape and structure. For example, the aerosol generating product 200 may include a first portion including at least one aerosol generating material and a second portion including a filter. The second portion of the aerosol generating product 200 may also include at least one aerosol generating material. For example, an aerosol generating material made in the form of granules or capsules may be inserted into the second portion.

The first portion may be completely inserted into the aerosol generating device 100, and the second portion may be exposed to the outside. Alternatively, part of the first portion may be inserted into the aerosol generating device 100, and the entire first portion and part of the second portion may be inserted into the aerosol generating device 100. The user may inhale the aerosol while holding the second portion between the user's teeth.

Figure 2:
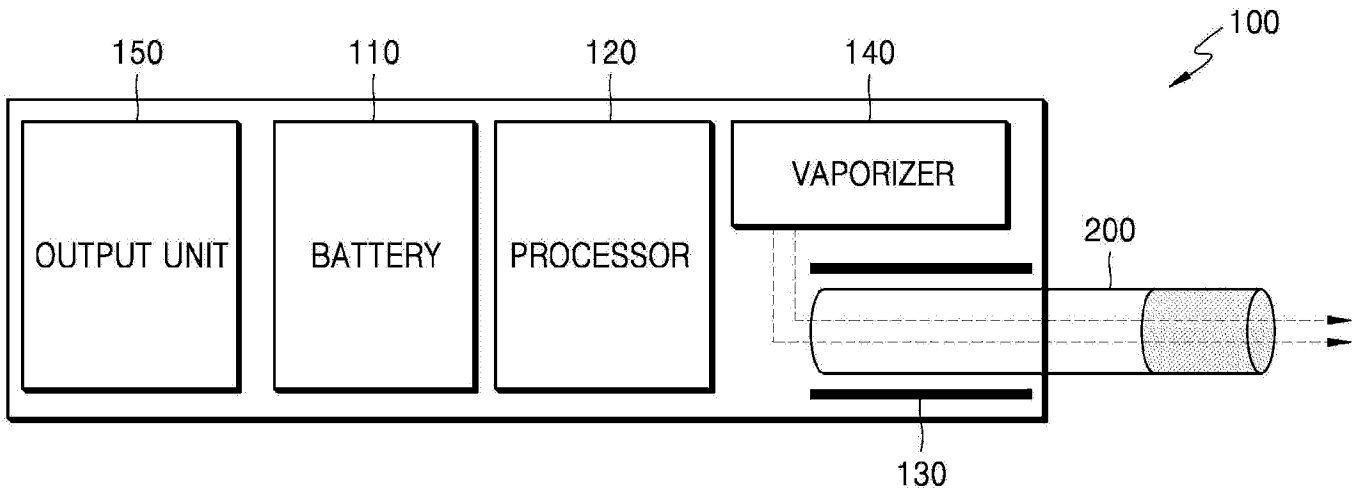
FIG. 2 illustrates another example of an aerosol generating device.

FIG. 2 illustrates another example of an aerosol generating device.

The aerosol generating product 200, the battery 110, the processor 120, the heater 130, the vaporizer 140, and the output unit 150 of FIG. 2 may correspond to the aerosol generating product 200, the battery 110, the processor 120, the heater 130, the vaporizer 140, and the output unit 150 of FIG. 1. Therefore, the descriptions already provided will not be repeated.

FIG. 2 illustrates an example in which the vaporizer 140 and the heater 130 are arranged in parallel. However, the internal structures of the aerosol generating device 100 are not limited to the illustrations of FIGS. 1 and 2. In other words, according to the design of the aerosol generating device 100, the arrangements of the battery 110, the processor 120, the heater 130, and the vaporizer 140 may be changed.

Figure 3:
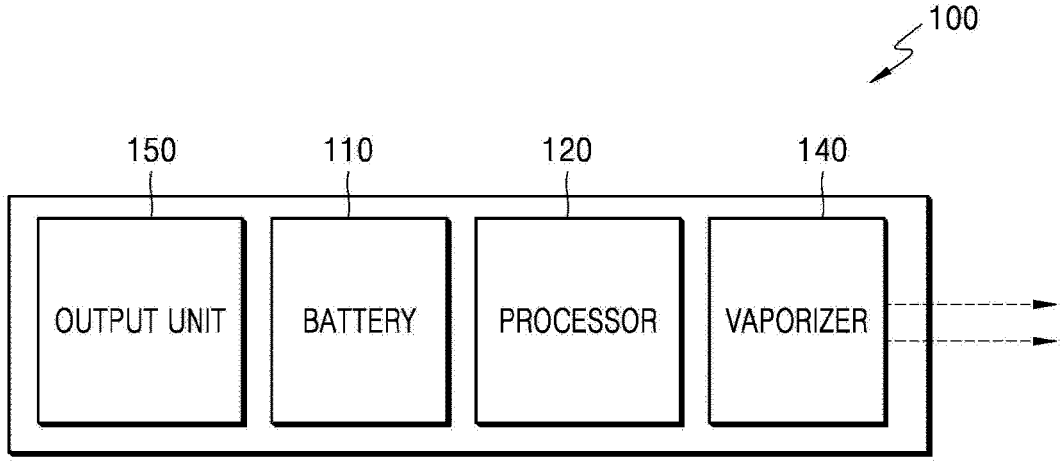
FIG. 3 illustrates another example of an aerosol generating device.

FIG. 3 illustrates another example of an aerosol generating device.

The battery 110, the processor 120, the vaporizer 140, and the output unit 150 of FIG. 3 may correspond to the battery 110, the processor 120, the vaporizer 140, and the output unit 150 of FIG. 1, respectively. Therefore, the descriptions already provided are not repeated.

When the example of FIG. 3 is compared to that of FIG. 1, the aerosol generating product 200 is not inserted into the aerosol generating device 100 of FIG. 3. That is, the aerosol generated by the vaporizer 140 may not pass through the aerosol generating product 200 and may be delivered directly to the outside (e.g., the user's mouth) of the aerosol generating device 100.

Consumables of the aerosol generating device 100 are consumed by user's smoking. For example, the liquid composition (including the aerosol generating material) stored in the liquid storage of the vaporizer 140 is consumed as the user smokes, and the aerosol generating material in the aerosol generating product 200 is consumed as well.

Also, the aerosol generating device 100 may operate by the power of the battery 110. Particularly, the heater 130 and the vaporizer 140 may be heated by the power of the battery 110, and thus, an aerosol generating material is vaporized. Therefore, as the user smokes, the remaining power of the battery 110 gradually decreases.

To smoothly use the aerosol generating device 100, the user needs to keep monitoring the remaining amount of consumables and the remaining power of the battery 110, which causes inconvenience to the user.

The aerosol generating device 100 monitors the consumables (e.g., the liquid compositions, the aerosol generating product 200, etc.) and the battery 110 and outputs a notification indicating whether more smoking is available. Also, while the battery 110 is charging, the aerosol generating device 100 may output a notification when the battery level becomes available for a next smoking act consisting of a certain number of puffs. Therefore, the user does not need to monitor the state of the aerosol generating device 100, and thus, the user convenience increases. Hereinafter, the term "smoking act" may refer to a user's act of smoking that involves a predetermined number of puffs.

The examples in which the aerosol generating device 100 monitors the consumables and the battery 110 and outputs notifications will be described below with reference to FIGS. 4 to 11.

FIG. 4 is a flowchart of an example of a method of controlling an aerosol generating device.

Referring to FIG. 4, the method of controlling the aerosol generating device 100 includes operations performed by the processor 120 of FIGS. 1 to 3. Therefore, although omitted, the descriptions regarding the processor 120 of FIGS. 1 to 3 may be applied to the method of controlling the aerosol generating device of FIG. 4.

In operation S410, the processor 120 identifies a first time point when power supply from the battery 110 to a heating element is discontinued, or a second time point related to power supply from an external device to the battery 110.

The heating element is a configuration for heating an aerosol generating material. For example, the heating element may correspond to the heater 130 or may be a heating means included in the vaporizer 140 described with reference to FIGS. 1 to 3.

The first time point may be when the power supply to the heating element is discontinued. For example, the first time point may be when one smoking act (i.e., a certain number of puffs) is terminated. In this case, the termination of the power supply to the heating element may be performed in response to a user input (e.g., pressing a button, etc.) or may be automatically performed by the processor 120.

The second time point is when an event related to the charging of the battery 110 occurs. For example, the second time point may be when the charging starts, a specific time point in the charging period, or a time point when the charging is terminated.

In operation S420, the processor 120 outputs a notification about the availability of the aerosol generating device 100 within a certain amount of time after the first time point or the second time point. For example, the processor 120 may control the output unit 150 to allow the output unit 150 to output a notification.

Here, a notification about the availability of the aerosol generating device 100 may indicate if the user may proceed to the next smoking without a hitch.

For example, when the consumables (e.g., the liquid composition, the aerosol generating product 200, etc.) are completely consumed, the user has to replace the consumables before start smoking. As another example, when the remaining power of the battery 110 is insufficient, the user needs to charge the battery 110. Therefore, in such cases, the processor 120 may control the output unit 150 to output a notification indicating that the aerosol generating device 100 is not available.

When the battery 110 is charged to a level that allows a single smoking act (i.e., a predetermined number of puffs), the processor 120 may control the output unit 150 to output a notification indicating that the aerosol generating device 100 is available for another smoking act.

For example, the notification may include at least one of an image, light, vibration, and sound. However, types of the notification are not limited thereto, and any notification delivering information to the user may be used. Also, the notification is not limited to one type. In other words, the notification may change as time passes.

Also, it is preferable that a notification is output within a reasonable time after the previous smoking act ended. Preferably, a notification may be output immediately after the user stops smoking so that the user may quickly notice whether next smoking is available. For example, the notification may be output within five seconds after the time point when the previous smoking act is terminated, but one or more embodiments are not limited thereto.

Although not shown in FIG. 4, the processor 120 may stop the operation of the aerosol generating device 100 when a certain amount of time has passed after the notification is output. In other words, after the notification indicating that the aerosol generating device 100 is not available is output, the processor 120 may stop operation of modules included in the aerosol generating device 100. Therefore, the aerosol generating device 100 may not operate unless the user solves the causes of unavailability (e.g., the exhaustion of consumables, a lack of remaining power of the battery 110, etc.). For example, the processor 120 may stop the operation of the aerosol generating device 100 in 30 seconds from the time point when the notification is output, but one or more embodiments are not limited thereto.

Hereinafter, referring to FIGS. 5 to 10, an example in which the processor 120 outputs the notification by using the output unit 150 is described.

FIG. 5 illustrates an example in which a processor outputs a notification by using an output unit.

FIG. 5 illustrates an example in which the amount of liquid composition in liquid storage 510 is changed as time passes. In this case, the amount of liquid composition is changed, depending on whether the user smokes.

At an initial time point $T_0$, the amount of liquid composition in the liquid storage 510 has a maximum value. For example, the initial time point $T_0$ may be when a new vaporizer 140 or a new liquid storage 510 is inserted into the aerosol generating device 100.

At a time point $T_1$ when a smoking act is terminated by the user, the amount of liquid composition in the liquid storage 510 has decreased by $L_1$. That is, the amount of liquid composition (hereinafter, 'the amount of one-time liquid consumption') consumed during one smoking act is $L_1$. In this case, the amount of one-time liquid consumption $L_1$ may be variously determined. An example of determining the amount of one-time liquid consumption $L_1$ is described below with reference to FIG. 6.

At a time point $T_m$ when an $m^{th}$ smoking act is terminated by the user, the remaining amount $L_m$ of liquid composition stored in the liquid storage 510 is less than the amount of one-time liquid consumption $L_1$. That is, the user may not be able to complete the $m+1^{th}$ smoking act (i.e., a predetermined number of puffs) because of the lack of the liquid composition. In other words, the $m+1^{th}$ smoking act may not be normally performed.

The processor 120 identifies the amount of the liquid composition in the liquid storage 510 every time user's smoking act ends at time points $T_0$, $T_1$, and $T_m$. When the remaining amount $L_m$ of liquid composition in the liquid storage 510 is less than the amount of one-time liquid consumption $L_1$, the processor 120 controls the control unit 150 to output a notification within a predetermined time period $\alpha$ after the single smoking act is terminated at $T_m$. Here, the time period $\alpha$ may be set properly such that the user may feel that the notification is output immediately after the smoking act is terminated at $T_m$. For example, the time period $\alpha$ may be five seconds, but it is not limited thereto.

Therefore, the user may recognize that the next smoking act (the $m+1^{th}$ smoking act) cannot be completed without replacing the liquid storage 510 or the vaporizer 140 including the liquid storage 510.

FIG. 6 illustrates the amount of one-time liquid consumption.

Referring to FIG. 6, the amount of one-time liquid consumption $L_1$ may be determined in various manners.

For example, the amount of one-time liquid consumption $L_1$ may be determined by considering various users 610. For example, the processor 120 may determine the amount of one-time liquid consumption $L_1$ by considering use histories of the aerosol generating device 100 of users around the world or users of a certain group.

As another example, the amount of one-time liquid consumption $L_1$ may be determined by considering only a specific user 620. The processor 120 may determine amount of one-time liquid consumption $L_1$ by considering a use history of the aerosol generating device 100 of the specific user 620. In this case, the amount of one-time liquid consumption $L_1$ may be differently determined depending on an environment in which the specific user 620 smokes. For example, the amount of one-time liquid consumption $L_1$ may be differently determined based on the season 631 and/or the time 632.

When the specific user 620 initially uses the aerosol generating device 100, the amount of one-time liquid consumption $L_1$ may be stored as a default value. In this case, the default value may be determined by considering various users 610 or may be an arbitrary value.

FIG. 7 illustrates another example in which a processor outputs a notification through an output unit.

FIG. 7 illustrates an example in which the remaining power of the battery 710 is changed as time passes. In this case, the remaining power is changed depending on the amount of power consumption of the aerosol generating device 100, especially depending on the amount of power consumption of the heating element (that is, the heater 130 and/or the vaporizer 140).

At the initial time point $T_0$, the remaining power of the battery 710 has a maximum value. For example, the initial time point $T_0$ may be when the battery 710 is fully charged.

At the time point $T_1$ when the initial smoking act is terminated by the user, the remaining power of the battery 710 has decreased by the amount of $B_1$. That is, the amount of power consumed during one smoking act (hereinafter, referred to as 'the amount of one-time power consumption') is $B_1$. In this case, the one-time power consumption $B_1$ may be determined in various manners. An example in which the onetime power consumption $B_1$ is determined will be described with reference to FIG. 8.

At a time point $T_n$ when an $n^{th}$ smoking act is terminated by the user, the remaining power $B_n$ of the battery 710 is less than the amount of power corresponding to one smoking act. In other words, at the time point $T_n$, the remaining power $B_n$ of the battery 710 is less than the one-time power consumption $B_1$, which means that the user may not complete a next smoking act (an $n+1^{th}$ smoking act) because of the lack of power of the battery. That is, the $n+1^{th}$ smoking act may not be normally performed.

The processor 120 checks the remaining power of the battery 710 every time a smoking act ends at $T_0$, $T_1$, and $T_n$. When the remaining power $B_n$ of the battery 710 is less than the one-time power consumption $B_1$, the processor 120 controls the output unit 150 to output a notification within a predetermined time period β after the single smoking act is terminated at $T_n$. The time period β may be set properly such that the user may feel that the notification is output immediately after the smoking act is terminated at $T_n$. For example, the time period β may be five seconds, but is not limited thereto.

Therefore, the user may recognize that it is not possible to complete a next smoking act (the $n+1^{th}$ smoking act) without charging the battery 710.

FIG. 8 illustrates one-time power consumption.

Referring to FIG. 8, the one-time power consumption $B_1$ may be determined in various manners.

For example, the one-time power consumption $B_1$ may be determined by considering various users 810. For example, the processor 120 may determine the one-time power consumption $B_1$ by considering use histories of the aerosol generating device 100 of users around the world or users of a specific group.

As another example, the one-time power consumption $B_1$ may be determined by considering only a specific user 820. The processor 820 may determine the one-time power consumption $B_1$ by considering the use history of the aerosol generating device 100 of the specific user 820. In this case, the one-time power consumption $B_1$ may be differently determined according to an environment in which the specific user 820 smokes. For example, the one-time power consumption $B_1$ may be differently determined based on the season 831 and/or based on the time 832.

When the specific user 620 initially uses the aerosol generating device 100, the onetime power consumption $B_1$ may be stored as a default value. In this case, the default value may be determined by considering various users 810 or may be an arbitrary value.

FIG. 9 illustrates another example in which a processor outputs a notification by using an output unit.

FIG. 9 illustrates an example in which the remaining amount (i.e., number) of an aerosol generating product 910 (e.g., a cigarette) is changed as time passes. As described above with reference to FIGS. 1 to 2, the aerosol generating product 910 may be inserted into the aerosol generating device 100, and the aerosol generating product 910 and/or the vaporizer 140 may form an aerosol together. For example, the aerosol generated from an aerosol generating material included in the vaporizer 140 may entrain at least one component included in the aerosol generating product 910 and may be discharged to the outside.

For example, the user may purchase a package including a plurality of aerosol generating products 910. In this case, the number of aerosol generating products 910 included in the package may vary. Also, one aerosol generating product 910 may be consumed by each smoking act. In this case, when no aerosol generating product 910 remains in the package, the user may not be able to smoke.

At the initial time point $T_0$, the remaining amount (that is, the remaining number) of the aerosol generating products 910 has a maximum value. For example, the initial time point $T_0$ may be when the user purchases the package.

At the time point $T_1$ when the initial smoking act is terminated by the user, one aerosol generating product 910 is consumed. That is, because of one smoking act, the number of aerosol generating products 910 in the package is reduced by one.

At a time point $T_1$ when an $1^{th}$ smoking act is terminated by the user, the last aerosol generating product 920 in the package is consumed, which means that the user may not perform a next smoking act (an $I+1^{th}$ smoking act). That is, the $I+1^{th}$ smoking act may not be normally performed.

The processor 120 counts the consumption amount of the aerosol generating product 910 every time a single smoking act is terminated at $T_0$, $T_1$, and $T_1$. The processor 120 controls the output unit 150 to output a notification within a predetermined time period γ after the last aerosol generating product 920 is consumed at $T_1$. Here, the time period γ may be set properly such the user may feel that the notification is output immediately after the smoking act is terminated at $T_1$. For example, the time period γ may be five seconds, but it is not limited thereto.

Therefore, the user may recognize that the next smoking act (the $I+1^{th}$ smoking act) may not be performed because the aerosol generating product (e.g., cigarette) ran out and that he or she needs to purchase another package. When the user purchases a next package, the processor 120 may reset a result of counting the consumption amount of the aerosol generating product 910. For example, the processor 120 may reset the count in response to a user input (e.g., pressing a button, etc.) Alternatively, the processor 120 may automatically reset the result after outputting the notification.

FIG. 10 illustrates another example in which a processor outputs a notification by using an output unit.

FIG. 10 illustrates an example in which battery 1010 is charged as time passes.

At the initial time point $T_0$, the remaining power of the battery 1010 has a minimum value. Here, the minimum value may indicate a state in which the battery 1010 is completely discharged or a state in which the remaining power of the battery 1010 is less than the amount that is required for one smoking act.

As charging of the battery 1010 progresses, the remaining power of the battery 1010 reaches the amount of power corresponding to one smoking act at the time point $T_k$. In other words, at the time point $T_k$, the battery 1010 may be charged to satisfy one smoking act.

The processor 120 may monitor a process of charging the battery 1010 and may control the output unit 150 to output a notification within a predetermined time period δ after the certain time point $T_k$. The time period δ may be set properly such that the user may feel that the notification is output immediately after the smoking act is terminated at $T_k$. For example, the time period δ may be five seconds, but it is not limited thereto.

Therefore, the user may be notified that the aerosol generating device is available for smoking and may smoke by using the aerosol generating device 100.

As described above with reference to FIGS. 1 to 3, the output unit 150 may include at least one of a display, a light source, a motor, and a speaker. Therefore, the output unit 150 may output various types of notifications. Hereinafter, examples of notifications are described with reference to FIG. 11.

FIG. 11 is a diagram illustrating different types of notifications.

Referring to FIG. 11, the output unit 150 may output a text message 151 indicating notification content. Alternatively, the output unit 150 may output a certain color 152 or a certain image 152 that corresponds to the notification content. Alternatively, although not shown in FIG. 11, the output unit 150 may flicker according to a certain emission type corresponding to the notification content. Alternatively, the output unit 150 may output vibration corresponding to the notification content. Alternatively, the output unit 150 may output sound indicating the notification content.

The output unit 150 may output a notification in various manners. For example, the text message 151, color 152, image 152, light emission pattern, vibration pattern, or sound may be changed as time passes.

As described above, the processor 120 according to an embodiment monitors the remaining amount of the consumables (e.g., the liquid compositions, the aerosol generating product 200, etc.) and the battery 110, and may output a notification of whether more smoking is available after the previous smoking is terminated by the user. Also, while the battery 110 is charging, when the amount of power corresponding to one smoking act is charged to the battery 110, the processor 120 may output a notification such that the user need not monitor the charging state of the aerosol generating device 100, thereby improving the user convenience.

The above-described method can be written as computer programs and can be implemented in general-use digital computers that execute the programs using a computer-readable recording medium. Also, structures of data used in the above-described method may be recorded on computer-readable recording media by using various media. Examples of the computer-readable recording medium include magnetic storage media (e.g., ROM, RAM, USB, floppy disks, hard disks, etc.), optical recording media (e.g., CD-ROMs or DVDs), etc.

Those of ordinary skill in the art related to the present embodiments may understand that various changes in form and details can be made therein without departing from the scope of the characteristics described above. Therefore, the disclosed methods should be considered in a descriptive point of view, not a restrictive point of view. The scope of the present disclosure is defined by the appended claims rather than by the foregoing description, and all differences within the scope of equivalents thereof should be construed as being included in the present disclosure.

The invention claimed is:

1. An aerosol generating device comprising:

a heating element configured to heat an aerosol generating material;

a battery configured to supply power to the heating element;

an output unit; and a processor configured to:

determine an amount of the aerosol generating material corresponding to one smoking act comprising a predetermined number of puffs or an amount of power that corresponds to the one smoking act comprising the predetermined number of puffs; and control the output unit to output a notification indicating that a remaining amount of the aerosol generating material is less than the determined amount of the aerosol generating material corresponding to the one smoking act or that a remaining amount of power of the battery is less than the determined amount of power that corresponds to the one smoking act, within a predetermined time period after power supply from the battery to the heating element is discontinued.

2. The aerosol generating device of claim 1, further comprising a storage configured to accommodate the aerosol generating material.

3. The aerosol generating device of claim 1, wherein the amount corresponding to the one smoking act is differently determined according to an environment in which a user smokes.

4. The aerosol generating device of claim 1, wherein the amount of power that corresponds to the one smoking act is differently determined according to an environment in which a user smokes.

5. The aerosol generating device of claim 1, wherein the processor is further configured to output a notification indicating a remaining number of an aerosol generating product, and the aerosol generating product is configured to deliver an aerosol generated from the aerosol generating material to user's mouth such that the aerosol entrains at least one component included in the aerosol generating product.

6. The aerosol generating device of claim 1, wherein the output unit comprises at least one of a display, a light source, a motor, and a speaker.

7. The aerosol generating device of claim 1, wherein the notification comprises at least one of an image, light emission, vibration, and sound.

8. The aerosol generating device of claim 7, wherein the image, the light emission, the vibration, or the sound of the notification is changed as time passes.

9. The aerosol generating device of claim 1, wherein the processor is further configured to discontinue operation of the aerosol generating device when a predetermined amount of time has passed after the notification is output.

* * * * *